US006004625A

United States Patent [19]

Ohshima

[11] Patent Number: 6,004,625

[45] Date of Patent: Dec. 21, 1999

[54] METHOD FOR ADHERING PARTICLES TO AN OBJECT BY SUPPLYING AIR IONS

[75] Inventor: Kuniyasu Ohshima, Ashikaga, Japan

[73] Assignee: Ibick Corporation, Ashikaga, Japan

[21] Appl. No.: 08/876,700

[22] Filed: Jun. 16, 1997

[51] Int. Cl.[6] ..... B05D 1/04; B05D 1/06

[52] U.S. Cl. ..... 427/421; 427/475; 427/483; 427/485

[58] Field of Search ..... 427/421, 427, 427/475, 483, 485

[56] References Cited

U.S. PATENT DOCUMENTS

| | | | |
|---|---|---|---|
| 4,002,777 | 1/1977 | Juvinall et al. | 427/483 |
| 4,377,603 | 3/1983 | Itoh et al. . | |
| 4,685,620 | 8/1987 | Law et al. | 427/475 |
| 4,735,360 | 4/1988 | Kirchner et al. . | |
| 4,836,137 | 6/1989 | Heine et al. . | |
| 5,567,468 | 10/1996 | Lucas | 427/475 |

OTHER PUBLICATIONS

Abstract SU–336915, XP 002048456, Section PQ, week 7615, Derwent Publications Ltd., London, GB; Class P42, AN 76–D4176X, Oct. 3, 1975.

*Primary Examiner*—Michael Lusignan
*Assistant Examiner*—Bret Chen
*Attorney, Agent, or Firm*—Christensen O'Connor Johnson & Kindness PLLC

[57] ABSTRACT

The present invention relates to a method for adhering particles on an object to form a coating thereon. The method includes spraying the particles onto the object, and continuously supplying air ions comprising positive air ions and negative air ions to both sprayed particles in an atmosphere and a surface of the object to be coated during a spraying operation.

9 Claims, 7 Drawing Sheets

Fig. 6a.
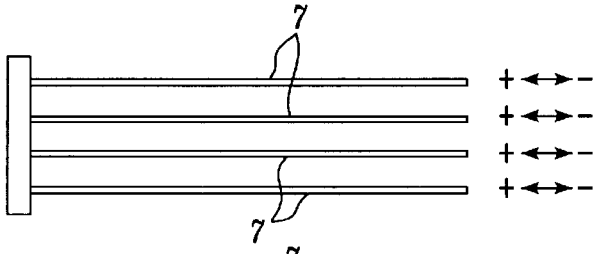
Fig. 6b.
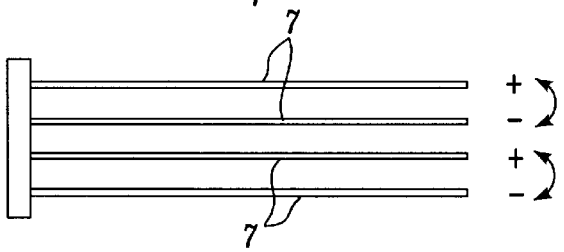
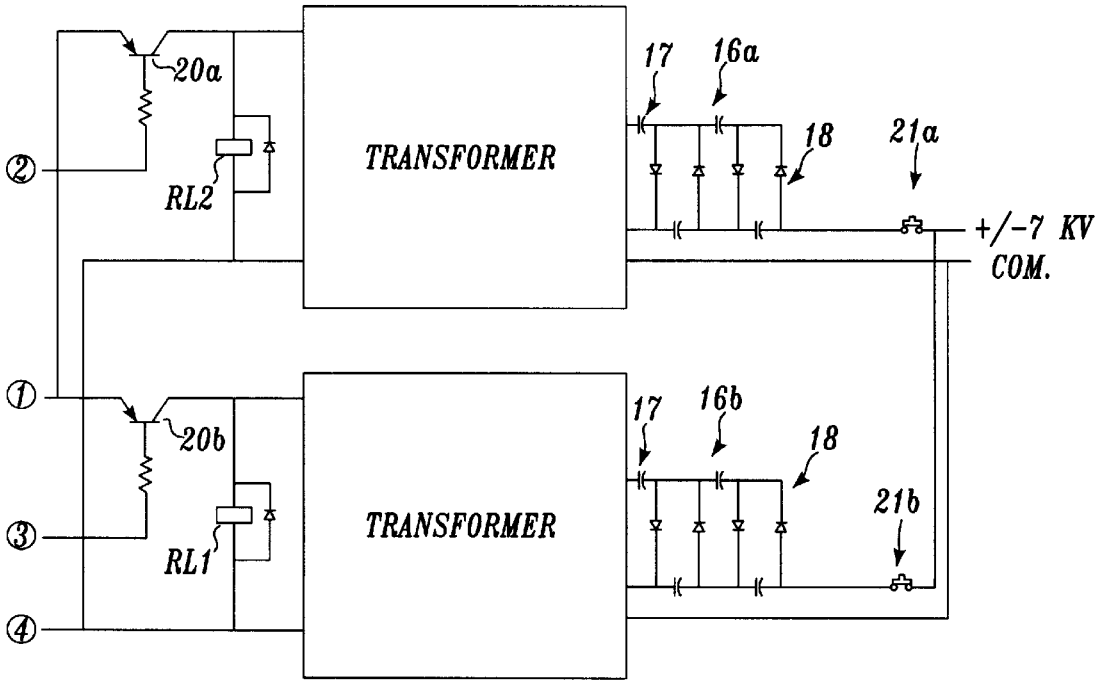
Fig. 7.

METHOD FOR ADHERING PARTICLES TO AN OBJECT BY SUPPLYING AIR IONS

FIELD OF THE INVENTION

This invention relates to a method and an apparatus for adhering particles to an object to form a coating thereon and more particularly to a method and an apparatus for spraying paint particles to the object. In the specification, an explanation of the invention is directed to painting but the invention is also applicable to other technique such as printing, and adhesion.

BACKGROUND OF THE INVENTION

For a painting, a good finishing of coating and a good efficiency of adhesion of paint particles are required. An electrostatic painting is widely used to acquire the latter requirement in which a paint spray gun is to be charged by a first potential and the spray gun emits charged paint particles, a target to be painted is to be charged by a second potential so that the electrically charged paint particles emitted by the spray gun have a first electric force applied to them urging the electrically charged paint particles toward the target. According to the electrostatic painting, the efficiency of adhesion of particles is increased and an amount of waste particles is greatly reduced.

It is, however, that according to the electrostatic painting, a force of collision between the particles and the target is strong so that a forming of an adhesion layer is rough which results in a bad finishing of a surface. In addition, safety measures add substantially to the cost, complexity and bulk of the electrostatic painting apparatus.

The present invention is mainly directed to provide a new method and an apparatus for adhering particles to the object in which, by supplying air ions, the good finishing of coating is obtained and the efficiency of adhesion is improved.

Generally, the air ions are used to neutralize the static charges. It is well known that a high concentration of both types of air ions acts to suppress accumulations of static electricity on objects to be coated. Static electrical charges attract air ions of the opposite polarity and the attracted ions then neutralize the static charges. In a pre-painting process, a use of ionizer which produce both positive and negative ions is known. For example, a spray booth in which the air ions are introduced into a chamber to neutralize and suppress a static electric charge and prevent a dust from clinging to an object to be coated is disclosed in Japanese laid-open patent No.8-84948 and Japanese utility Model Registration No-3018050.

SUMMARY OF THE INVENTION

According to the present invention, in a method for adhering particles on an object to form a coating thereon, particles are sprayed to the object in which air ions comprising positive air ions and negative air ions are continuously supplied to both sprayed particles in an atmosphere and the surface to be painted. The present method is different from the prior arts in above-mentioned Japanese documents in that the air ions are continuously supplied during a spraying operation. According to the present method, the coating of good finishing and the good adhesion between particles themselves and between the particles and the surface to be coated are obtained.

It is believed that the air ions comprising the positive and the negative air ions affect the paint particles and the surface to be painted somehow thereby contributing to the good adhesion between the particles and the surface to be coated and the good adhesion between particles themselves. The wetting property of the surface may be improved by continuously supplying the air ions to the surface. The sprayed particles in the atmosphere may be charged by continuously supplying air ions to the sprayed particles and the charged particles are electrostatically attracted to each other resulting in the good adhesion between the particles. The surface (which includes a surface of layer of painted particles as well as the surface of the object) may be charged by continuously supplying the air ions to the surface. considering the fact that a thickness of the coating of paint particles of the present invention is thicker than that of normal spraying, other spraying conditions being equal, an electrostatic force may have something to do with the formation of coating.

Though the mechanism of formation of coating is not clearly understood, according to a hypothesis, the particle is charged in which the particle has both a positive electrostatic charge and a negative electrostatic charge at opposite positions from each other. The particle which normally has a positive electric charge at first when it is sprayed may be neutralized by the negative ion, but by continuously supplying positive and negative ions to the particle, the particle may be charged according to FIG. 1(*a*) and portions of opposite electric charges attract each other to form a layer as shown in FIG. 1(*b*). According to this hypothesis, it is desirable to supply equal numbers of positive and negative ions to the particles and the surface to be painted.

The object to be coated is made of any materials such as metal, wood, plastic, paper and the like. The particles are made of water-soluble paint particle, powder paint particle, organic-soluble paint particle, ink and the like. It is found that the organic-soluble paint particle and the powder paint particle are preferably selected. It is found that in case of the water-soluble paint particles, preferably, the positive ions and the negative ions are alternately supplied to the particles at predetermined interval, a few seconds for example. Preferably, an air-less spray such as a centrifugal spray is selected. In case of an air spray, the air ions may be diluted by a sprayed air.

According to the present invention, a spray booth apparatus for spraying particles to an object while continuously supplying air ions of positive air ions and negative air ions is provided. The apparatus comprises a chamber for accommodating the object and an air ionizer which is provided in a ceiling or a side wall of the chamber to supply both the positive air ions and the negative air ions in the chamber.

Preferably, the ionizer comprises at least a pair of air ionizing electrodes and a D.C. voltage supply which produces both positive and negative high voltages to apply voltages of opposite polarities to the ionizing electrodes. According to a D.C. voltage type ionizer, it is easier to control a ratio of the production of the positive ions and the negative ions.

More preferably, the ionizer further comprises means for interchanging the polarities of said ionizing electrodes at a predetermined interval. An erosion of the positive electrode progresses faster than that of the negative electrode because molecules are collided with the positive electrode at the time of corona discharging. Because of the interchange of the polarities of the electrodes, the electrode erosion of both electrodes are averaged thereby preventing an imbalance of production of positive and negative ions and prolonging the life of the electrodes. In addition, the interchange of the polarities of the electrodes prevents the dust from clinging to the electrodes.

In another aspect of the invention, the ionizer comprises at least-one air ionizing electrode, a D.C. voltage supply which produces both positive and negative high voltages to apply a voltage of either polarity to the ionizing electrode and means for interchanging the polarity of the ionizing electrode at a predetermined interval. This type of ionizer is preferably used for the water-soluble particles.

According to the method of the present invention, the coating having increased strength is obtained because of the good adhesion between the particles. Accordingly, by spraying particles on the surface of liquid such as water, the coating is formed on the surface. The coating may be removed from the surface and obtained as a film. Alternatively, by pressing an object onto the coating, the coating is transferred to the surface of the object by a liquid pressure.

BRIEF DESCRIPTION OF THE DRAWINGS

FIGS. 6(*a*) and 6(*b*) show interchanges of polarities of electrodes corresponding to the circuit of FIG. 9 and the circuit of FIG. 8, respectively.

FIG. 7 shows a high voltage supply.

DETAILED DESCRIPTION OF THE PREFERRED EMBODIMENTS

Figure 1A:
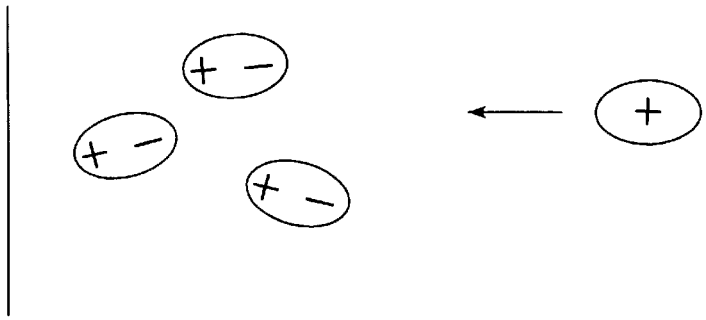
FIGS. 1(*a*) and 1(*b*) show a model of charged particles in an atmosphere comprising positive air ions and negative air ions in a non-layered condition and in a layered condition, respectively.
Figure 1B:
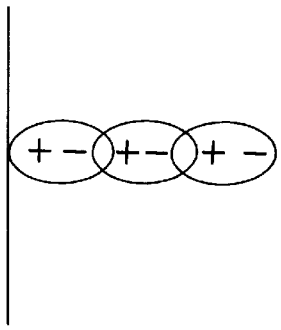
Figure 2:
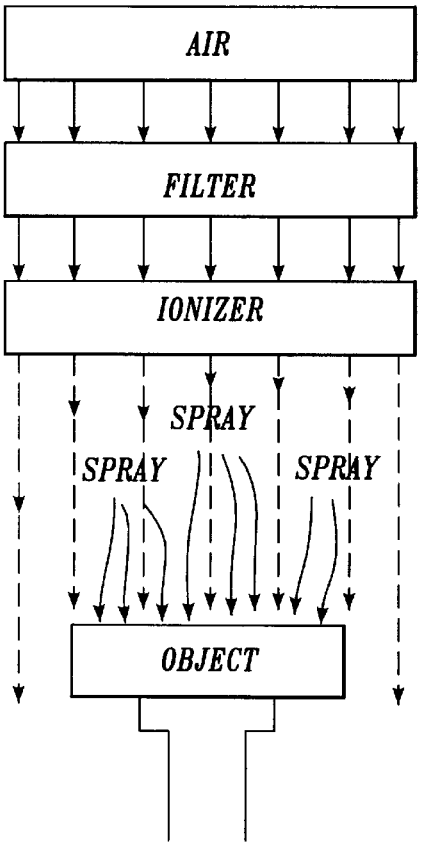
FIG. 2 is a schematic view showing a method of the present invention.

FIG. 2 shows a painting method of the present invention. An air introduced is cleaned by an air filter and is inonized by an air inonizer and positive air ions and negative air ions are produced. The positive air ions and the negative air ions are supplied to a surface of an object to be painted. Then paint particles are sprayed to the surface of the object. During a spraying operation, the air ions comprising the positive air ions and the negative air ions are continuously supplied to both sprayed particles in the atmosphere and the surface to be coated.

Figure 3A:
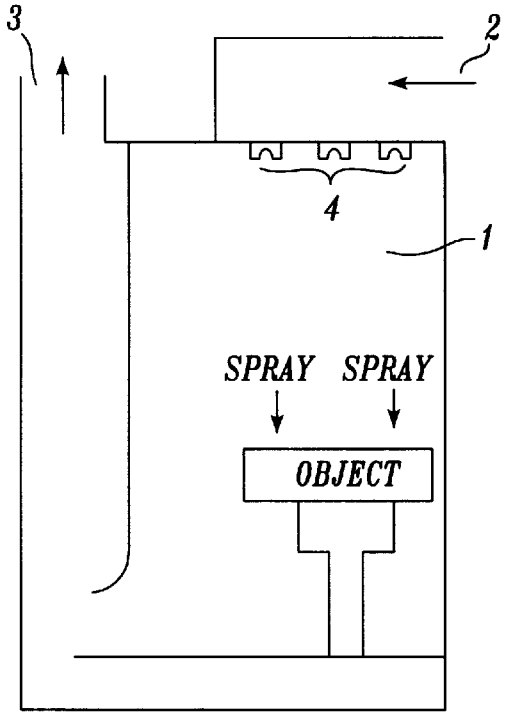
FIGS. 3(*a*), (*b*) are side elevations showing two types of spray booths.
Figure 3B:
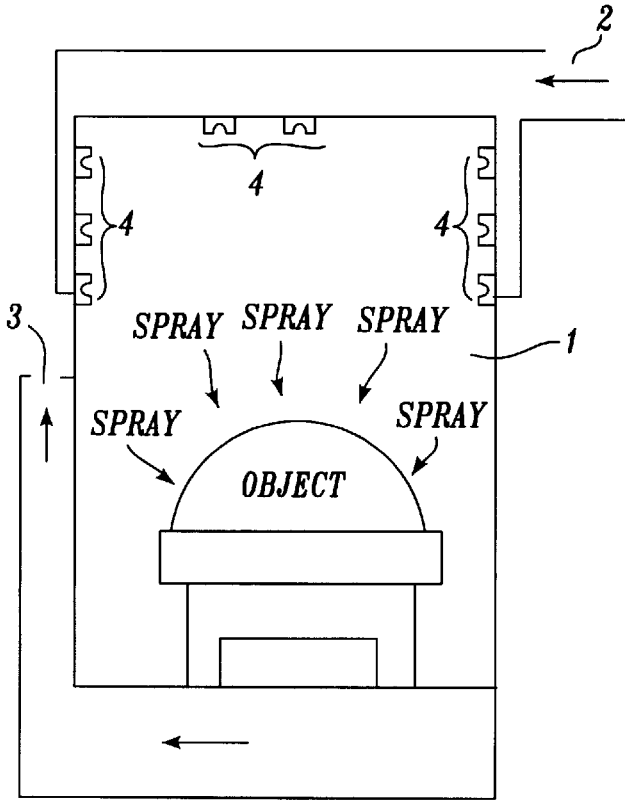

As shown in FIGS. 3(*a*) and 3(*b*), a spray booth comprises a chamber 1 for accommodating the object to be coated, an air inlet 2 and an air outlet 3, and the air ionizer 4 which is provided in a ceiling or a sidewall of the chamber 1 and is adapted to receive the air from the outside of the chamber 1 to generate both positive and negative ions and supply them into the chamber 1. Preferably, the air introduced is cleaned by an air filter. In the chamber 1, the object is placed to receive an ion shower. In case of a spray booth, by continuously supplying the air ions, the chamber 1 is filled with air ions and an atmosphere comprising positive ions and negative ions is obtained when the paint particles are sprayed in that atmosphere, the air ions are supplied to the sprayed particles.

The air ionizer 4 comprises a charging unit 5 (see FIG. 4) which is provided in an upper wall and/or a side wall of the chamber 1 and a power control unit 6 (FIG. 5) which is separated from the charging unit 5 and is provided outside the chamber 1.

Figure 4:
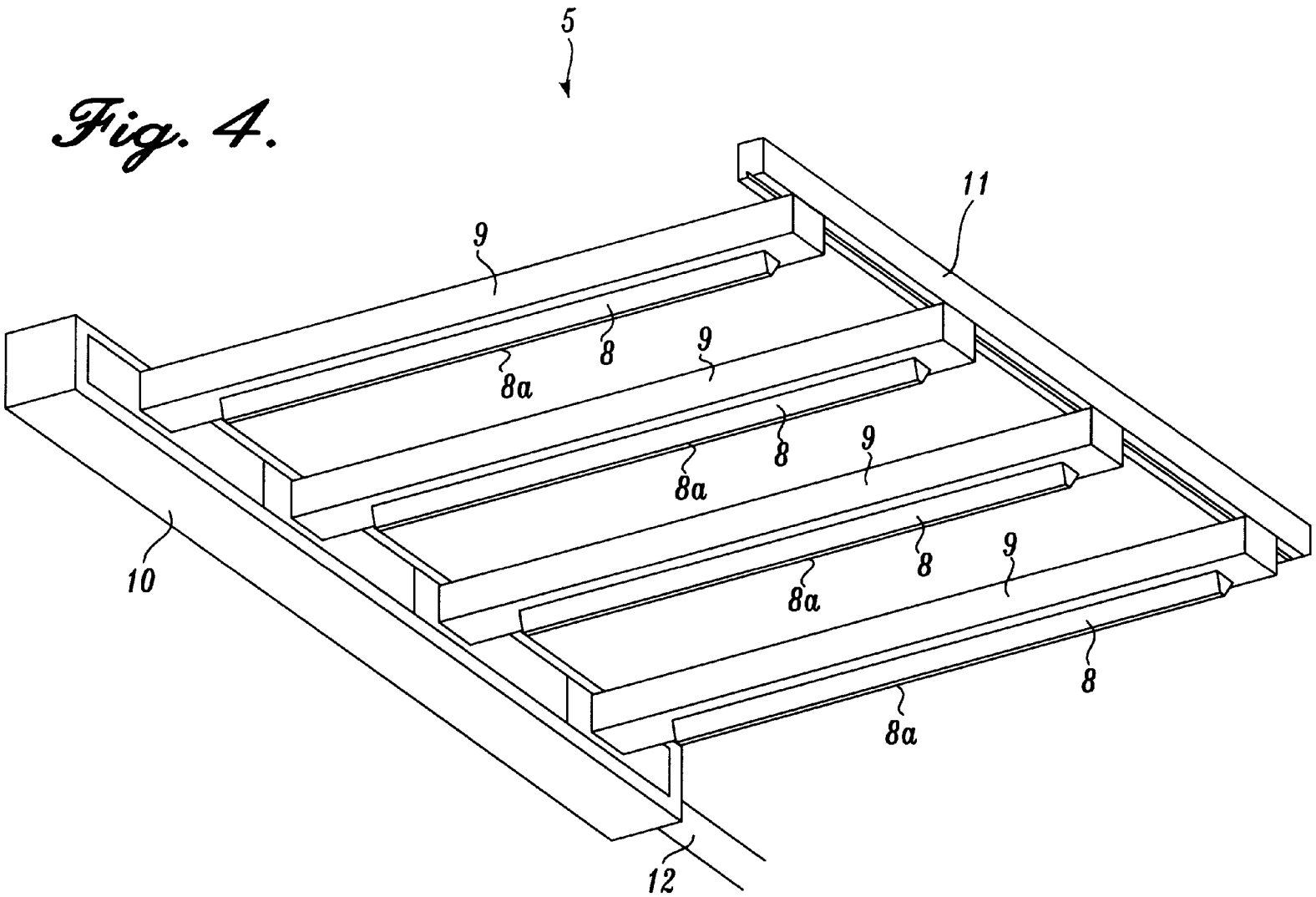
FIG. 4 is a perspective view of a charging unit of an air ionizer of the present invention.

Referring to FIGS. 4, 6(*a*), and 6(*b*), the charging unit 5 comprises four discharging wires 7 which constitute ionizing electrodes and cartridges 8 accommodating the electrodes, first supporting members 9 which extend along with the cartridges 8, second and third supporting members 10, 11 which extend substantially perpendicularly to the first supporting members 9 and a D.C. voltage supply which produces both positive and negative high voltages to apply voltages of opposite polarities to the ionizing electrodes. The electrodes are spaced apart and are paralleled with each other. Upper portions of the cartridges 8 are supported by the first supporting members 9. One ends of the first supporting members 9 are supported by the second supporting member 10 and the other ends of the first supporting members 9 are supported by the third supporting member 11.

The first and the second supporting members 9, 10 have a hollow portion therein and one ends of the first supporting members 9 are open ends and communicate with the second supporting member 10. The second supporting member 10 has a closed end and an open end and the open end is provided with an air hose 12 which supply an air from the outside of the chamber 1. The elongate cartridge 8 which accommodates the electrode has a slit 8*a* which is provided at lower portion of the cartridge 8 and is extended in an extending direction of the wire 7. The electrode wire 7 is made of tungsten having a diameter of 60 micron and has an Au plating.

The first supporting members 9 are slidably mounted at the second and the third supporting members 10, 11 in extending directions of the second and the third supporting members 10, 11. Therefore, spaces between the electrodes can be selected in accordance with the object to be coated.

Figure 5:
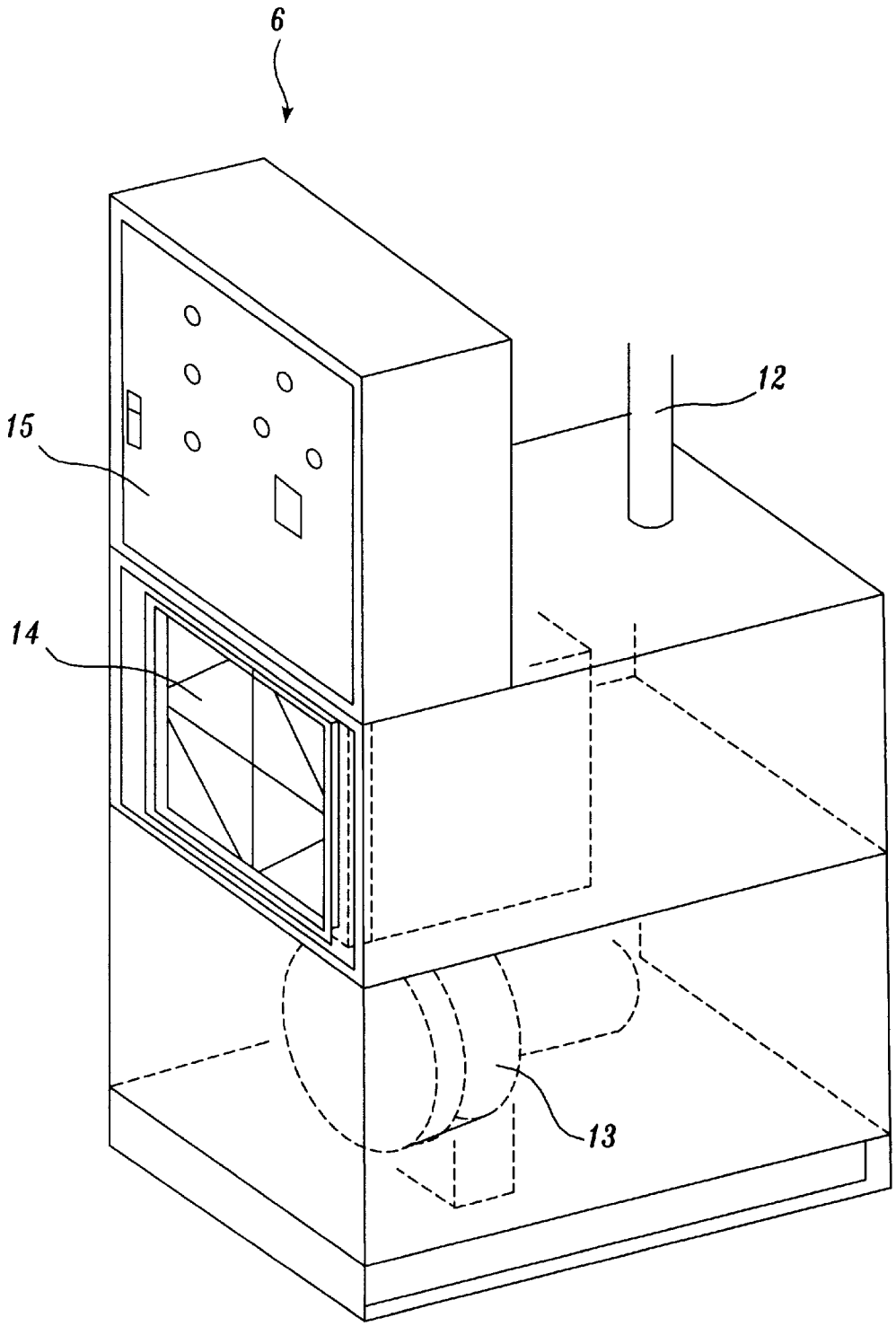
FIG. 5 is a perspective view showing a control unit of an air ionizer of the present invention.

Referring to FIG. 5, the power control unit 6 comprises a blower 13, a filter 14, a control panel 15 and an air inlet. The air flow created by the blower 13 is supplied to the charging unit 5 via the air hose 12. A rotation of blower 13 and a charging of the electrode are synchronized so that the entry of paint particles to the cartridge 8 is prevented. An amount of air flow is also adjustable by controlling the rotation of the blower 13.

Referring to FIGS. 6(*a*) and 6(*b*), the ionizer 4 of the embodiment is a D.C. voltage type ionizer in which the electrode wire 7 becomes a positive electrode by charging a positive D.C. voltage bias and the electrode wire 7 becomes a negative electrode by charging a negative D.C. voltage bias. If two of the four wires 7 are charged by the positive voltage and the rest two wires 7 are charged by the negative voltage, the ionizer 4 produces both the positive ions and the negative ions at the same time.

Referring to FIG. 7, a high voltage supply comprises a pair of transformers and the primary windings of transformers receive direct currents and alternating currents are obtained at the secondary windings of the transformers. The secondary windings are connected to electrodes via multiplying and rectifying circuits 16*a*, 16*b* which comprise a plurality of capacitors 17 and diodes 18 so that a high D.C. voltage of either polarity is applied to the electrodes.

Figure 8:
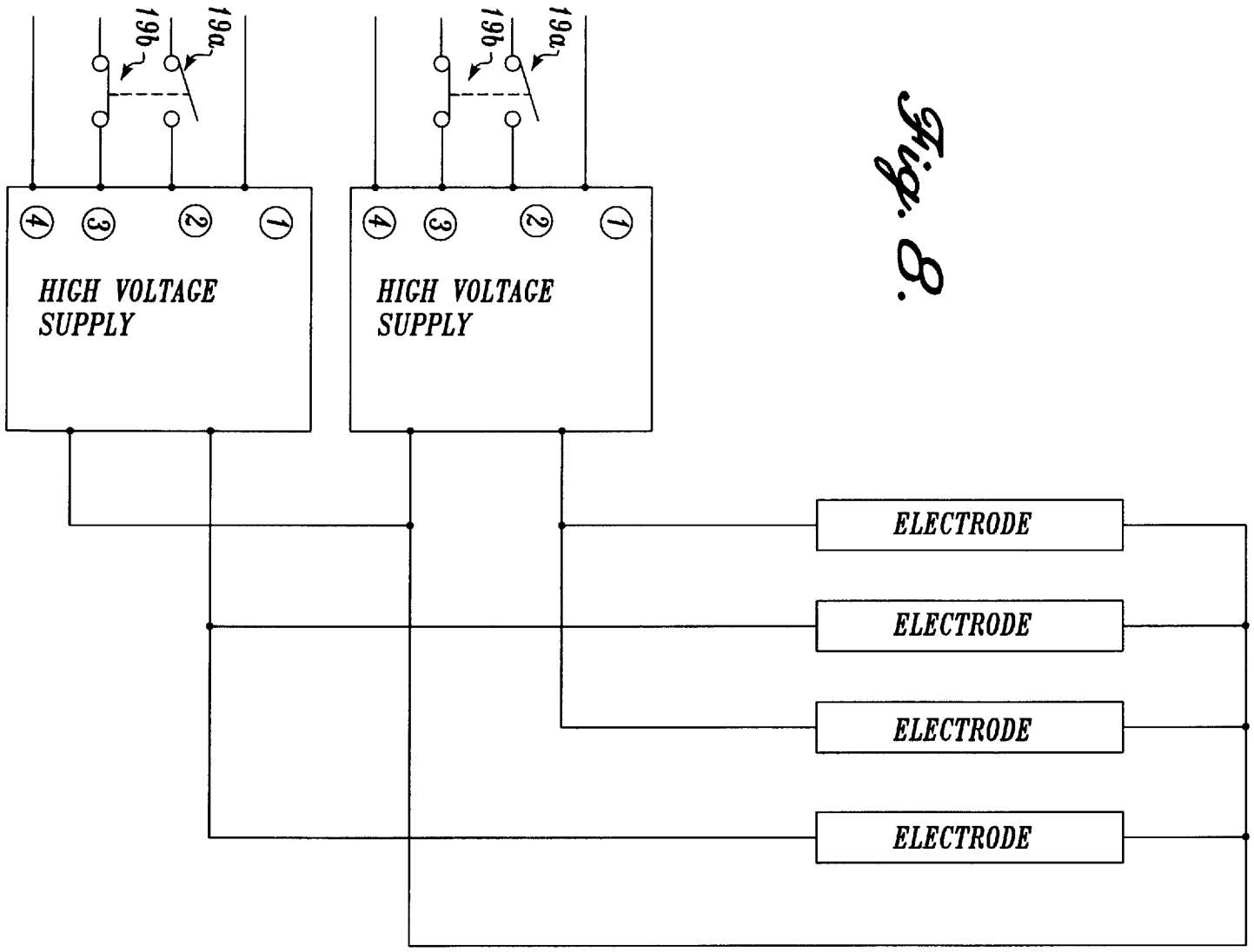
FIG. 8 is a circuit diagram showing a first embodiment of the interchanges of polarities.
Figure 9:
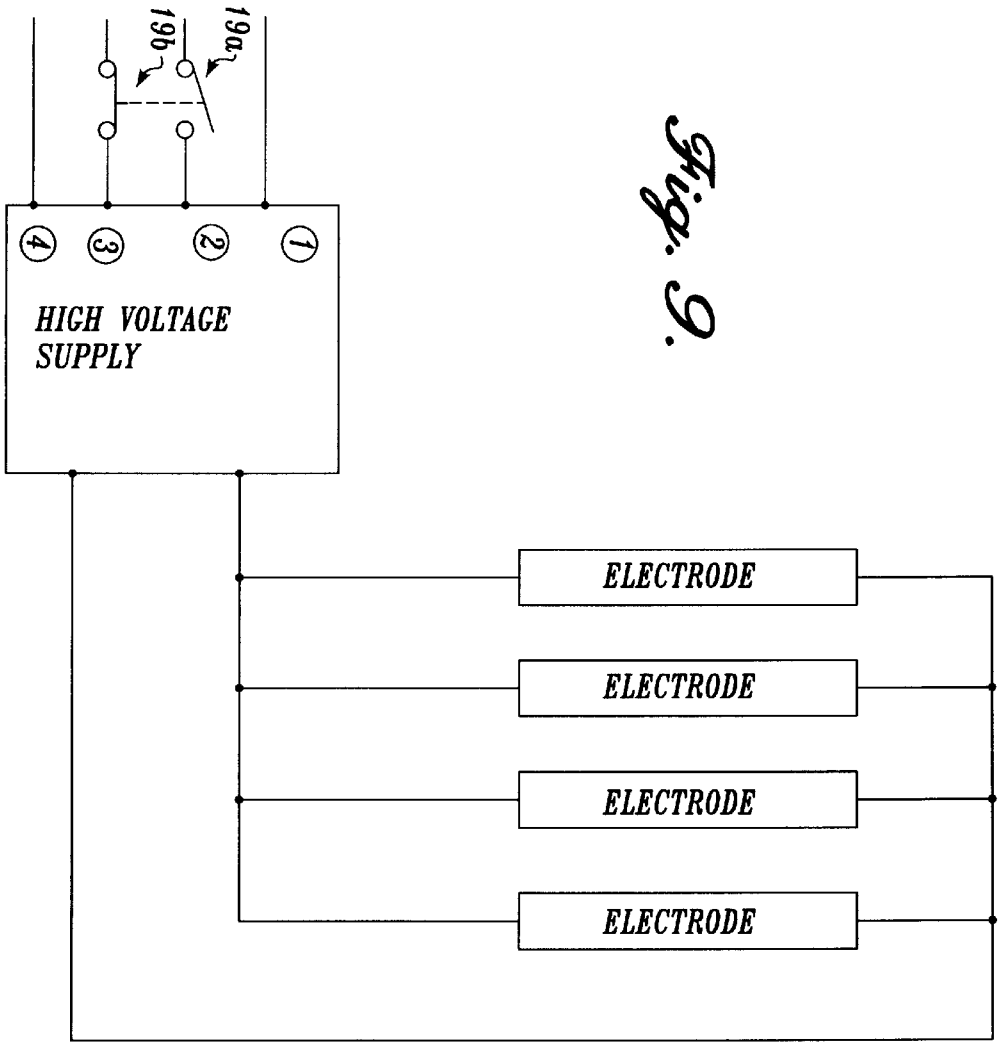
FIG. 9 is a circuit diagram showing a second embodiment of the interchanges of polarities.

Referring additionally to FIGS. 8 and 9 according to the air ionizer 4 of the present invention, the ionizer 4 comprises means for interchanging the polarity of the electrodes at a predetermined interval. A relay for switching the polarity of D.C. current voltage which is to be applied to the electrodes is comprised of a make contact 19*a* and a break contact 19*b*. When the make contact 19*a* is opend, the break contact 19*b* is closed and vice versa. When the make contact 19*a* is closed, a switch 20*a* is switched on and a contact 21*a* for RL2 is closed so that the negative high D.C. voltage is applied to the electrodes. When the break contact 19*a* is closed, a switch 20*b* is switched on and a contact 21*b* for RL1 is closed so that the positive high D.C. voltage is applied to the electrodes, in this regard, FIG. 8 shows four electrodes and two a pair of high voltage supplies in which two electrodes are connected to a first high voltage supply of a first polarity and the other two electrodes are connected to a second high voltage supply of a second polarity. FIG. 9 shows four electrodes which are connected to a high voltage supply in which high D.C. voltage of either polarity is applied to all electrodes at the same time. FIGS. 6(*a*) and 6(*b*) show interchanges of polarity of electrodes in which (a) corresponds to the circuit of FIG. 9 and (b) corresponds to the circuit of FIG. 8.

Figure 10:
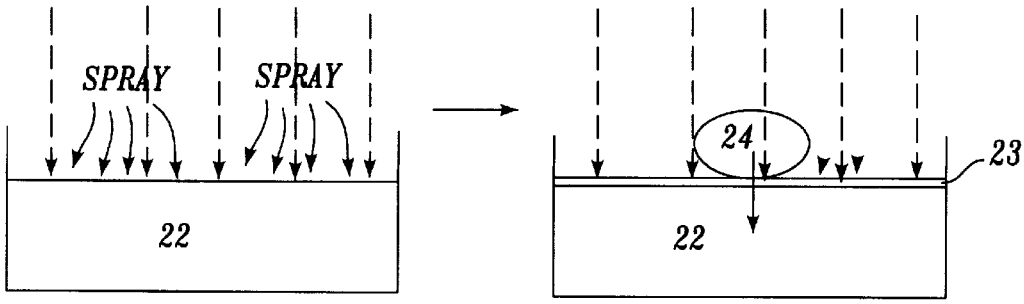
FIG. 10 shows another embodiment of a method for coating.

FIG. 10 shows another embodiment of a method for coating. In this embodiment, particles are sprayed on a surface of a liquid 22 such as water and a coating 23 is formed on the surface of liquid 22 which is regarded as a first object. The coating 23 may be removed from the surface and obtained as a film. Alternatively, a second object 24 is pressed onto the coating 23 and the coating 23 is transferred to the surface of the second object 24 by a liquid pressure. The liquid 22 is preferably selected according to the specific gravity of the coating particles and in most cases, the water is preferably selected. The coating 23 may be comprised of layers in which a first layer of the surface is a clear coating, a second layer on the first layer is an enamel coating and a third layer on the top is a primer coating.

EXAMPLE 1

TABLE 1

| | sample 1 | samp1e 2 |
|---|---|---|
| gloss | 85.3 degrees | 93.2 degrees |
| hardness | HB | 2H |
| adhesion | 100/100 | 100/100 |

particulars (1)substrate: ABS resin (sample 1 and sample 2)

(2)spray condition:

sample 1: an air atmosphere, 25 degrees Celsius, 55% humidity /enamel paint—10 minutes' setting—clear paint—drying (60 minutes, 70 degrees Celsius)

sample 2: an air atmosphere, 25 degrees Celsius, 55% humidity+continuously supplying both positive air ions and negative air ions during spraying operation/enamel paint—10 minutes' setting—clear paint—drying (60 minutes, 70 degrees Celsius)

(3)gloss: 60 degrees mirror surface reflection rate/ the digital deflection angle gloss measuring instrument(UGV-50 type Suga)

(4)hardness: the pencil scratching instrument using Mitsubishi uni (Toyo Seiki)

(5)adhesion: gobanme test after 240 hours in the water 40 degrees Celsius/ the cross cut guide (Kotex)

Those examinations correspond to JIS(Japanese Industrial Standard) K 5400. As shown in the table 1, sample 2 has advantages in gloss and hardness.

EXAMPLE 2

TABLE 2

| | sample 1 | sample 2 |
|---|---|---|
| thickness | 40 micron | 70 micron |

particulars (1)substrate: ABS resin of 20 cm×30 cm (2)coating: enamel paint (30 g), clear paint (30 g)

(3)spraying condition sample 1: enamel paint—10 minutes' setting—clear paint—drying (60 minutes, 60 degrees Celsius)—setting time 2 hours sample 2: continuously supplying both positive air ions and negative air ions during spraying operation/enamel paint—10 minutes' setting—clear paint—drying (60 minutes, 60 degrees Celsius)—setting time 2 hours.

The result of the example 2 shows that the present method has an advantage in forming a thicker coating.

According to the example 1 and 2, substantially equal numbers of positive and negative air ions are supplied. However, the ratio of the positive and the negative air ions is not limited to the example. Some imbalances of the positive and the negative ions are tolerable to obtain a preferable result compared with the normal spray coating.

What I claim is:

1. A method for adhering particles on an object to form a coating thereon, said method comprising:

spraying the particles onto the object; and simultaneously and continuously supplying air ions comprising positive air ions and negative air ions both to sprayed particles in an atmosphere and to a surface of the object to be coated during a spraying operation.

2. The method as claimed in claim 1, said method comprising:

accommodating the object in a chamber;

continuously supplying the air ions comprising the positive air ions and the negative air ions in said chamber and obtaining an atmosphere comprising the positive air ions and the negative air ions in said chamber; and spraying the particles to the object in said atmosphere.

3. The method as claimed in claim 1, wherein said particles are water-soluble and the positive air ions and the negative air ions are alternately supplied to the sprayed particles and the object at a predetermined interval.

4. The method as claimed in claim 3, wherein the air ions are supplied by an air ionizer which comprises at least one air ionizing electrode, a D.C. high voltage supply producing both positive and negative high voltages to apply a voltage of either polarity to said ionizing electrode and means for interchanging the polarity of said ionizing electrode at a predetermined interval.

5. The method as claimed in claim 1, wherein the air ions are supplied by an air ionizer which produce both the positive air ions and the negative air ions.

6. The method as claimed in claim 5, wherein said ionizer comprises at least a pair of air ionizing electrodes and a D.C. high voltage supply which produces both positive and negative high volrages to apply voltages of opposite polarities to said ionizing electrodes.

7. The method as claimed in claim 6, said ionizer further comprising means for interchanging the polarities of said ionizing electrodes at a predetermined interval.

8. The method as claimed in claim 1, wherein the object is liquid and the particles are sprayed on a surface of the liquid to form the coating on the surface.

9. The method as claimed in claim 8, wherein an object is pressed onto the surface of the liquid and the coating is transferred to a surface of the object by a liquid pressure.

* * * * *

UNITED STATES PATENT AND TRADEMARK OFFICE

CERTIFICATE OF CORRECTION

PATENT NO. : 6,004,625
DATED : December 21, 1999
INVENTOR(S) : K. Ohshima

It is certified that error appears in the above-identified patent and that said Letters Patent is hereby corrected as shown below:

Column 6,
Line 34 (Claim 2, line 8), after "particles" delete "to" and insert -- onto --
Line 42 (Claim 4, line 3), "high voltage" should read -- high-voltage --
Line 48, (Claim 5, line 2) "produce" should read -- produces --
Line 52, (Claim 6, line 3) "high voltage" should read -- high-voltage --

Signed and Sealed this

Twenty-third Day of October, 2001

*Attest:*

Nicholas P. Godici

NICHOLAS P. GODICI
*Acting Director of the United States Patent and Trademark Office*

*Attesting Officer*